US009408257B2

(12) United States Patent
Lollar

(10) Patent No.: US 9,408,257 B2
(45) Date of Patent: Aug. 2, 2016

(54) SILICONE BAND CABLE HEATER ASSEMBLY, METHOD OF MAKING AND METHOD OF USE

(71) Applicant: TUTCO, Inc., Cookeville, TN (US)

(72) Inventor: James Patrick Lollar, Baxter, TN (US)

(73) Assignee: Tutco, Inc., Cookeville, TN (US)

( * ) Notice: Subject to any disclaimer, the term of this patent is extended or adjusted under 35 U.S.C. 154(b) by 209 days.

(21) Appl. No.: 14/136,035

(22) Filed: Dec. 20, 2013

(65) Prior Publication Data

US 2015/0181652 A1 Jun. 25, 2015

(51) Int. Cl.

| | |
|---|---|
| ***H05B 3/08*** | (2006.01) |
| ***H05B 3/56*** | (2006.01) |
| ***H05B 3/06*** | (2006.01) |
| *H01R 43/048* | (2006.01) |

(52) U.S. Cl.

CPC .. *H05B 3/56* (2013.01); *H05B 3/06* (2013.01); *H01R 43/048* (2013.01); *Y10T 29/49195* (2015.01)

(58) Field of Classification Search

CPC ..... H05B 3/56; H05B 3/06; H05B 3/08; H05B 3/565; H05B 3/58; H05B 3/50; H01R 43/048; H01R 43/0484; H01R 43/05; H01R 43/10; Y10T 24/1484; Y10T 24/1604; Y10T 24/168; Y10T 24/1482; F24H 9/1818; B22D 17/2038

See application file for complete search history.

(56) References Cited

U.S. PATENT DOCUMENTS

| | | | | |
|---|---|---|---|---|
| 3,370,156 | A | 2/1968 | Graves | |
| 6,557,620 | B2 | 5/2003 | Oshimo | |
| 8,581,157 | B2 * | 11/2013 | Springer | H05B 3/56 219/528 |

* cited by examiner

*Primary Examiner* — Shawntina Fuqua
(74) *Attorney, Agent, or Firm* — Clark & Brody

(57) ABSTRACT

A silicone band heater assembly includes a silicone heater cable, lead wires, and a zip tie connection. The heater cable consists of a resistance heater wire that is optionally surrounded by a fiberglass braid, which in turn is encased in a silicone insulator. Each end of the heater cable includes an overmolded zip tie segment, which includes the splice connection between the lead wire and resistance wire, and the ability to link the ends of the heater cable assembly together when being clamped to a desired structure.

19 Claims, 5 Drawing Sheets

SILICONE BAND CABLE HEATER ASSEMBLY, METHOD OF MAKING AND METHOD OF USE

FIELD OF THE INVENTION

The present invention is directed to a silicone band heater cable assembly and particularly to a band heater having improved mechanisms to couple ends of the band together when applied to a structure to be heated.

BACKGROUND ART

The use of band heaters is well known in the prior art, see U.S. Pat. No. 3,370,156 to Graves. One type of band heater uses resistance heating wherein a resistance heating wire or heater cable is encased in a metal sheath. The metal sheath is in contact with the item or material to be heated or a structure containing a material needed to be heated. These heaters are often referred to as belly-band, crankcase, compressor or sump heaters and are often times used to heat refrigeration compressors or air-conditioning compressors. The heater can employ a standard hose clamp or other type of clamping arrangement for attachment to the compressor. The standard hose clamp is cut in two pieces with each piece affixed (welded for example) to opposite ends of the heater's metal sheath. Assembly of the heater to the compressor is accomplished by engaging the two ends of the clamp as intended and then tightening the assembly around the selected compressor location. This type of heater construction can also be used for heating containers such as barrels, heating pipes, etc.

Another type of band heater is one that employs a resistance heating cable encased in a silicone band. Examples of these types of band heaters are shown in U.S. Pat. No. 6,557,620 to Oshimo and U.S. Pat. No. 8,581,157 to Springer et al. In these types of heaters, the elements used for coupling the ends of the band together are normally overmolded to the heating cable and some type of structure is employed in connection with the overmolded elements to link the ends together. Typically, the structure is a tensioning device that permits the band heater to be securely clamped to the structure to be heated.

A band heater made by Raychem employs zip ties as the structure to couple the band ends together. This band heater is not like the resistance wire band heaters described above because it employs a self regulating semiconductor type material housed by a metal braid and outer insulation and uses a ground wire. This type of heating cable is expensive, limited in temperature and application choices, and has limited available wattages. The zip tie elements connected to the ends of the heating cable are held in place with adhesive and heat shrink tubing. The heat shrink tubing used is high strength to assure the integrity of the connection between the heating cable and zip tie element, but this type of tubing is also very expensive.

Zip ties are well known connectors for securing things and like uses, see www.zip-tie.com as an example of such zip ties. In its common form, the nylon cable tie consists of a tape section with triangular teeth that slope in one direction. The head of the cable tie has a slot with a flexible device that irreversibly rides up the slope of these teeth when the tape is inserted. The pawl engages, the backside of these teeth to stop removal of the tape. Other types use hook and loop fasteners with one end of the tie having the hooks and the other end having the loops. One end is passed through the slot in the head of the tie and is secured to the other end by virtue of the hook and loop engagement. Still others are considered releasable or reusable by having an additional tab, which has the flexible device noted above on it. The tab can be manipulated to disengage the teeth of the tie with the flexible device to allow the end of the tie to be retracted back through the slot in the head of the tie to release the tension caused by the zip tie when tightened. An example of these types of ties is found at http://www.alliance-express.com/standard-releasable-ties.

The prior art silicone band heaters still need improvement in terms of minimizing expense and simplifying the connection of the band ends. The present invention provides an improved silicone band heater that is inexpensive to produce and offers great flexibility in terms of its connection and clamping to a structure to be heated.

SUMMARY OF THE INVENTION

A first object of the present invention is a silicone band heater having an improved way to connect the band ends together when clamping to a structure in need of heating.

Another object of the invention is a method of making the silicone band heater by using zip ties.

Yet another object of the invention is an improvement in the method of heating a media using a silicone band heater.

Other objects and advantages of the present invention will become apparent as the description thereof proceeds.

The invention is an improvement in heaters employing a silicone heating cable assembly, wherein the ends of the cable are connected together and clamped to a component for heating purposes. The cable assembly includes lead wires and zip tie segments, which allow ends of the heating cable to be linked together for clamping.

More particularly, the silicone heater cable assembly includes a heater cable assembly comprising a resistance wire encased in a silicone insulator, with the heater cable assembly having a first cable end and a second cable end. The assembly also includes a pair of lead wires and a splice connection between one end of each lead wire and a bare end of the resistance wire extending from each of the first and second cable ends of the heater cable assembly.

The zip tie is divided into a first zip tie segment comprising a head end with a slot and first tape section and a second zip tie segment comprising a second tape section. Each of the first and second tape sections have an opening sized to allow the lead line to pass therethrough. The first tape section is attached to at least one splice connection to create a first attached portion and the second tape section is attached to at least the other splice connection to create a second attached portion.

With the zip tie segments attached, the second tape section of the second zip tie segment can pass through the slot in the head end of the first zip tie segment to form a connected heater cable for clamping to a structure for heating.

In one embodiment, the attached portions are attached using molding compound to form overmolded portions. Another embodiment can employ a mechanical crimping arrangement.

When using overmolding, the overmolded portions can each be surrounded by heat shrink tubing and the tape sections of the zip tie segments can either abut end faces of the cable or overlap them.

In the overmolding embodiment, it is preferred that the tape sections are arranged so that the splice connection is between the tape section and the structure/material to be heated. This arrangement keeps the tape section on the less heated side of the cable and this prolongs the life of the heater assembly.

To ease the splice connection and the manipulation of the tape section, the first and second tape sections can each be formed with a step. The step would contain the opening that the lead wire passes through. With the step in the tape section, the tape section does not have to be folded or bent to accommodate the lead wire when there is no step in the tape section.

In the overmolded embodiment, each overmolded portion includes a molding compound that surrounds a portion of the heater cable, a portion of the tape section, and the splice connection.

The zip tie can be any type of a zip tie, including those that are releasable so that they can be reused if desired.

The heater cable can also include a fiberglass braid positioned between the resistance wire and the silicone insulation.

The invention also is an improvement in the use of band heaters to heat structure and/or materials, e.g., a compressor. The use of the inventive band heater provides a number of advantages over conventional band heaters when used in these types of heating applications.

The invention also includes the method of making the silicone band heater. This method provides a silicone heater cable having a resistance wire and a silicone insulator, the silicone heater cable having a first cable end and a second cable end. Also provided is a pair of lead wires. Each end of a lead wire is crimped to each end of each resistance wire to form a pair of splice connections. A tape section of a zip tie segment with an opening in it is positioned adjacent to at least the splice connection at each cable end and the lead wire is threaded through the opening. Each tape section, each splice connection, each lead wire, and each of the first and second cable ends are attached together to form an attached portion so that the zip tie segments can be used to connect the first and second ends of the heater cable together. The attachment can be done by overmolding or mechanical crimping. Each of the tape sections can have a step where the opening is located.

BRIEF DESCRIPTION OF THE DRAWINGS

Reference is now made to the drawings of the invention as described below.

DESCRIPTION OF THE PREFERRED EMBODIMENTS

The present invention offers significant improvements in the field of silicone band heaters, including the heaters themselves, and their methods of use and making. By the use of the invention, improvements are realized in terms of manufacturing costs, ease of use, and improved heat conduction.

The band heater assembly of the invention provides a very strong, isolated heater band, built from using a simple zip tie cut into 2 pieces (saving the cost of an extra long zip tie). The design is extremely easy to install since it does not have to be slid over the top of a structure as is commonly done in prior art band heaters for compressors. For example, the inventive band heater can be installed after the compressor suction lines have been attached.

Figure 1:
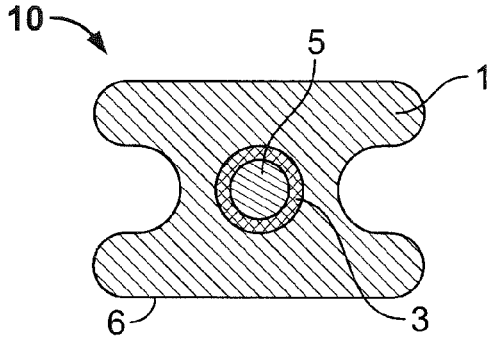
FIG. 1 is a sectional schematic view of a silicone heater cable for use in the invention.

FIGS. 1-7 and 9 illustrate one embodiment of the invention. FIG. 1 shows a silicone heater cable 10 having a silicone insulation 1, that is in the shape of an I-beam. The silicone insulation 1 surrounds a fiberglass braid 3, which in turn surrounds a resistance wire 5. It should be understood that the resistance wire 5 can take the form of a wire that is helically wound on a fiber center core, which acts as an arbor. Hereinafter, either embodiment, a solid resistance wire or the helically wound wire on the core are called a "resistance wire." Since the helically wound resistance wire is well known by itself, an illustration is not deemed necessary for understanding of this embodiment. In fact, any type of resistance wire used in these types of band heaters is suitable for use herein. The resistance wire, when supplied with power, generates heat, which is conducted through the silicon insulation to the structure that would be in contact with face 6 of the heater cable 10.

Figure 2:
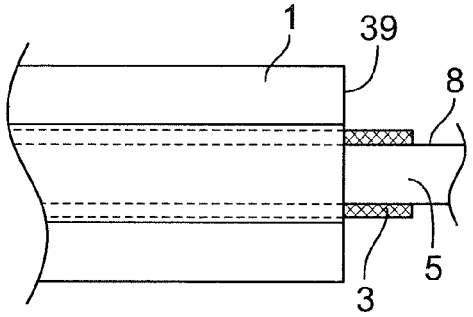
FIG. 2 is a side schematic view of the cable of FIG. 1 with insulation removed to show the resistance wire and fiberglass braid surrounding the wire.

FIG. 2 shows the end of the heater cable 10, where a portion of the silicone insulation is removed to expose the fiberglass braid 3 and wire 5. A portion of the fiberglass braid 3 is removed to produce a bare wire for splicing to a lead wire.

Figure 3:
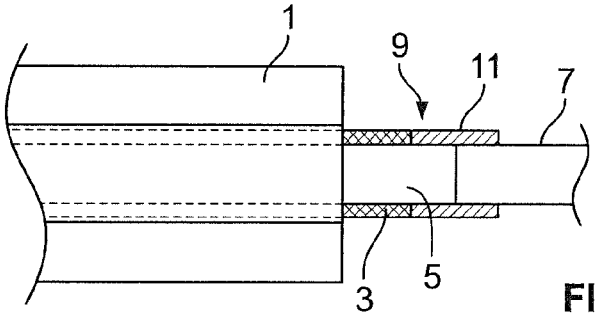
FIG. 3 is a splice connection connecting a lead wire to the wire of FIG. 2.

FIG. 3 shows the splice connection 9 between the exposed end 8 of the wire 5 and the lead wire 7. A metal crimp 11, as is known in the art, is used to mechanically link the end 8 of the wire 5 to the end of the lead wire 7.

Figure 4:
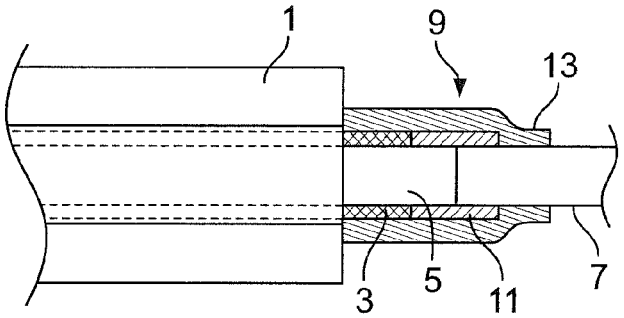
FIG. 4 shows the splice connection of FIG. 3 with heat shrink tubing surrounding it.

In FIG. 4, a heat shrink tubing 13 can be used to surround the crimp 11 and exposed fiberglass braid 3 to make the splice connection strong.

In FIGS. 3 and 4, the fiberglass braid 3 is shown in combination with the resistance wire 5 and silicone insulation 1. However, the braid 3 could be omitted so that only the wire 5 and the silicone insulation 1 are used for heating purposes.

In addition, in FIG. 3, the fiberglass braid 3 is shown to surround the wire 5 when the silicone insulation 1 is removed. However, the fiberglass braid 3 could also be removed with the silicone insulation 1 such that the bare resistance wire 8 extends from the end of the silicone insulation 1 that still covers the resistance wire 5.

Figure 5A:
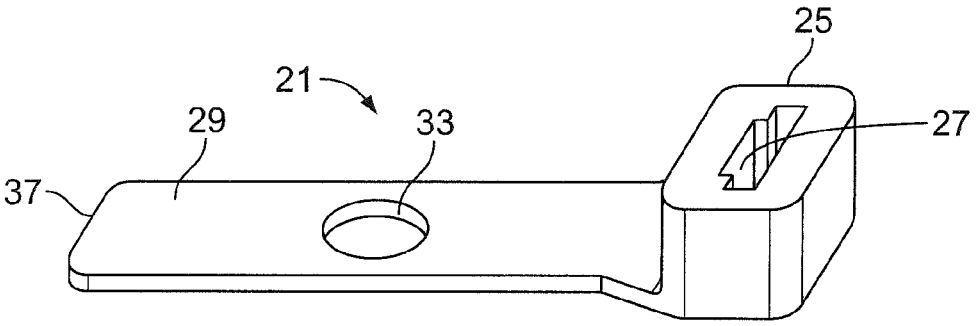
FIG. 5A shows one type of a zip tie for use with the heater cable of FIG. 1.
Figure 5B:
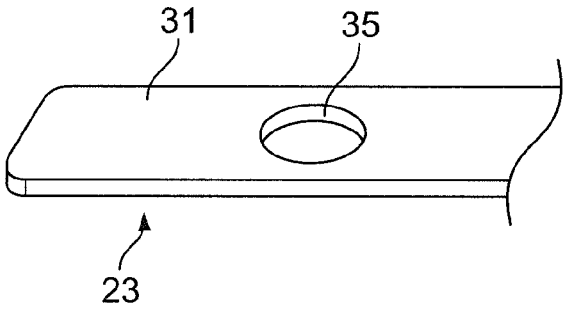
FIG. 5B shows a part of another type of zip tie for use with the heater cable of FIG. 1.
Figure 10:
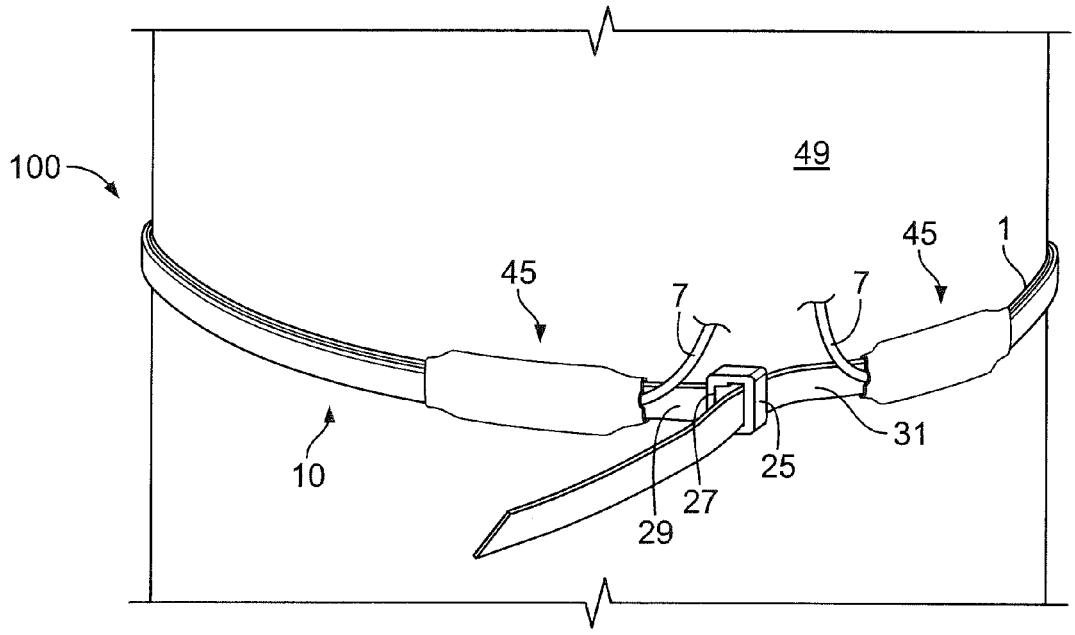
FIG. 10 shows the embodiment of FIGS. 1-7 attached to a surface for heating purposes.

The band heater assembly, see FIG. 10, of the invention uses a zip tie to secure ends of the heater cable 10 together, as seen in FIGS. 5*a* and 5*b*. Here, a zip tie is cut into two segments, a first zip tie segment 21 and a second zip tie segment 23. The segment 21 includes the head end 25 with its slot 27 and a tape section 29, which is used to attach to one end of the heater cable 10.

The other zip tie segment 23 just comprises a tape section 31 having a length so that the end of the tape section 31 can be inserted into the slot 27 of the head end for pulling of the ends of the heater cable 10 together and clamping the heater cable assembly to a structure for heating. It should be understood that the tape section includes the teeth that engage in the slot 27, although the teeth are not illustrated since this configuration is well known in the field of zip ties.

Each of the zip tie segments 21 and 23 has a throughhole or opening 33 and 35, respectively. The throughholes 33 and 35 are sized to permit the lead wire 7 to pass therethrough to enhance the attachment of each tape section 29 and 31 to each splice connection 9. The fact that the wire 7 is pulled through the hole 33 in the zip tie segment 21 and then molded into place, as detailed below, means it would take extreme tension to pull the zip tie loose and therefore the zip tie can provide the strength needed while the zip tie is being pulled into place on a given structure, e.g., a compressor shell.

Figure 6:
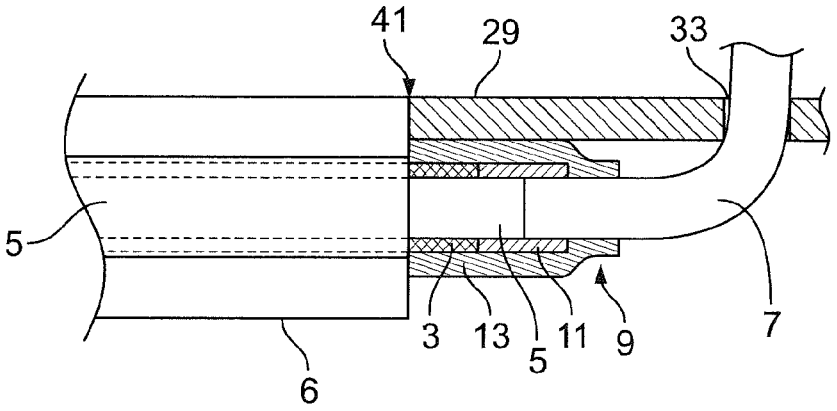
FIG. 6 shows a tape section of one of the zip tie segments arranged to be attached to the splice connection, lead wire, and resistance wire.

Referring to FIG. 6, the end 37 of the tape section 29 of the zip tie segment 21 is butted against the end face 39, see FIG. 2, at 41 and the lead wire 7 extends through the opening 33 in the tape section 29. In FIG. 6, it should be noted that the splice connection 9 is disposed between the tape section 29 and a structure (not shown) that the face 6 of the heater cable 10 would rest on when the band heater is in place for heating. In this way, the heated portion of the band is adjacent to the structure and this forces the heat to move toward the structure and the tape section 29 is kept cooler during heating operation.

Once the tape section 29 is in place, the tape section can be overmolded to hold it in place. This overmolding is a well known technique and is used in other band heaters so that the details thereof are not needed for understanding of the invention. The overmolding layer is shown in FIG. 7 as 43 and the overmolded part of the heating cable assembly having the splice connection and tape section of the zip tie segment is identified with the reference numeral 45.

Typically, a silicone molding compound is applied to one side of the assembly and pressed into place. This is followed by molding compound being applied to the opposite side as well. The silicone molding compound is then pressed and heated so that the material will bond to itself and the components of the heater cable and splice connection. Since the overmolding process would be automated, trimming the molding compound from the heater cable is normally not a requirement. The overmolding .process produces a low profile molding that insulates the electrically live portions and bonds the molding compound to the heater band and itself. The overmolding method allows the molding compound to stick to itself during the overmolding step. This adds substantial strength to the band heater assembly. Once the compound cures it is difficult to pull the cured compound through the zip tie segment slot 27 and break the band heater assembly.

Figure 7:
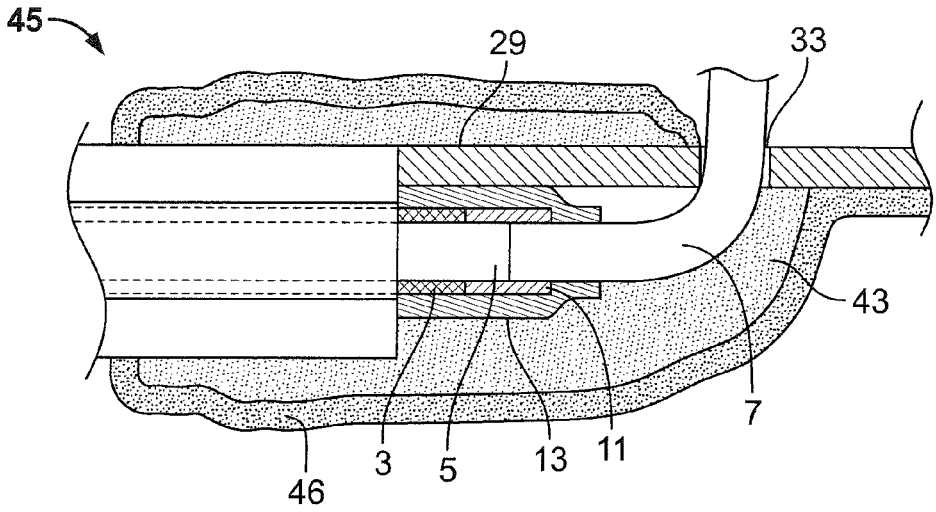
FIG. 7 shows the arrangement of FIG. 6 with an overmolding to secure the connection between the lead wire and the heater cable.

If desired, the overmolded part of the cable assembly can be surrounded with another heat shrink tubing 46, which is also shown in FIG. 7. However, the heater cable assembly is perfectly functional using just the splice connection 9 with its crimp and heat shrink tubing 13, and throughhole-containing zip tie segment 21. It should also be understood that for the splice connection 9, it is possible to use just the metal crimp to attach the ends of the lead wire 7 and the resistance wire 5 together, but the use of the heat shrink tubing 13 does improve the connection.

The overmolding 43 can be trimmed to size so that it is more similar in shape to the heater cable 10. This also helps in reducing any fit problems with the band heater and the structure intended to receive it.

The assembly shown in FIG. 7 also exists for the tape section 31 of the zip tie segment 23.

Figure 8:
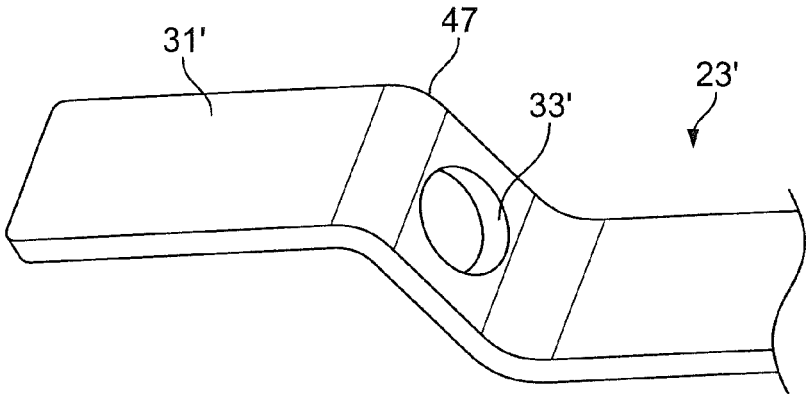
FIG. 8 shows an alternative zip tie segment configuration.
Figure 9:
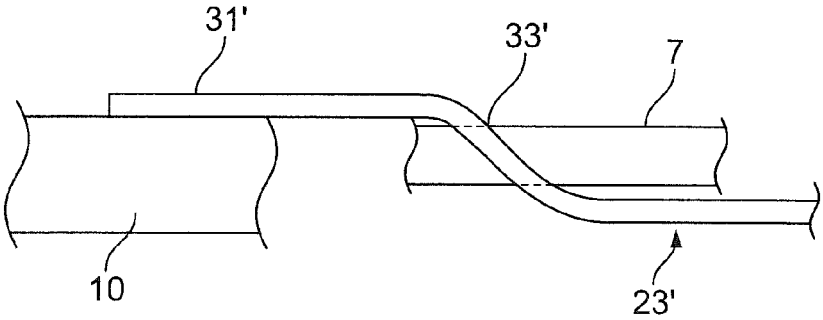
FIG. 9 shows how the zip tie segment of FIG. 8 interfaces with a lead wire.

While the tape sections are shown as relatively planar when attached to the splice connection 9, the tape sections could be preformed with a step 47 as shown in the alternative zip tie segment 23' in FIGS. 8 and 9. In this embodiment, the tape section 31' has the throughhole 33' where the step 47 occurs. This means that the tape section does not have to be bent or folded to form the configuration shown in FIG. 6 to get the abutting configuration 41. Thus, the lead wire 7 can extend in a more linear fashion through the throughhole 33' as shown in FIG. 9. FIG. 9 also shows schematically how the tape section could overlap the heater cable 10 rather than use the abutting connection shown in FIG. 6. The details of the splice connection 9 and exposed resistance wire 5 are not shown in FIG. 9 to make the drawing more clear.

Although the zip tie segment 21 is shown in an abutting relationship with the heater cable 10 at 41 in FIG. 6, the tape section 29 could be positioned so that a part of it overlaps onto the silicone insulation 1. Consistent with the overmolding shown in FIG. 7, the overmolding would cover the tape section 29 as well as silicone insulation 1 adjacent to where the tape section 29 terminates.

FIG. 10 shows a schematic drawing of the band heater in place on the surface 49 of a structure, with the tape section 31 of the zip tie segment 23 extending through the slot 27 in the head 25 of the tape section 29 of the zip tie segment 21.

In operation, the tape section 31 would be fed through the slot 27 and pulled to draw the two overmolded portions 45 together and securely clamp the band heater to the surface 49 of the structure.

While overmolding is used as one way to connect the tape section of the zip tie segment to the heater cable and the lead wire, a mechanical crimping arrangement can also be used. This embodiment is shown in FIGS. 11-14. For each of these embodiments, the zip tie segment is attached to the heater cable to form an attached portion, whether the attachment is done using an overmolding and molding compound or the attachment is obtained by a mechanical effort.

Figure 11:
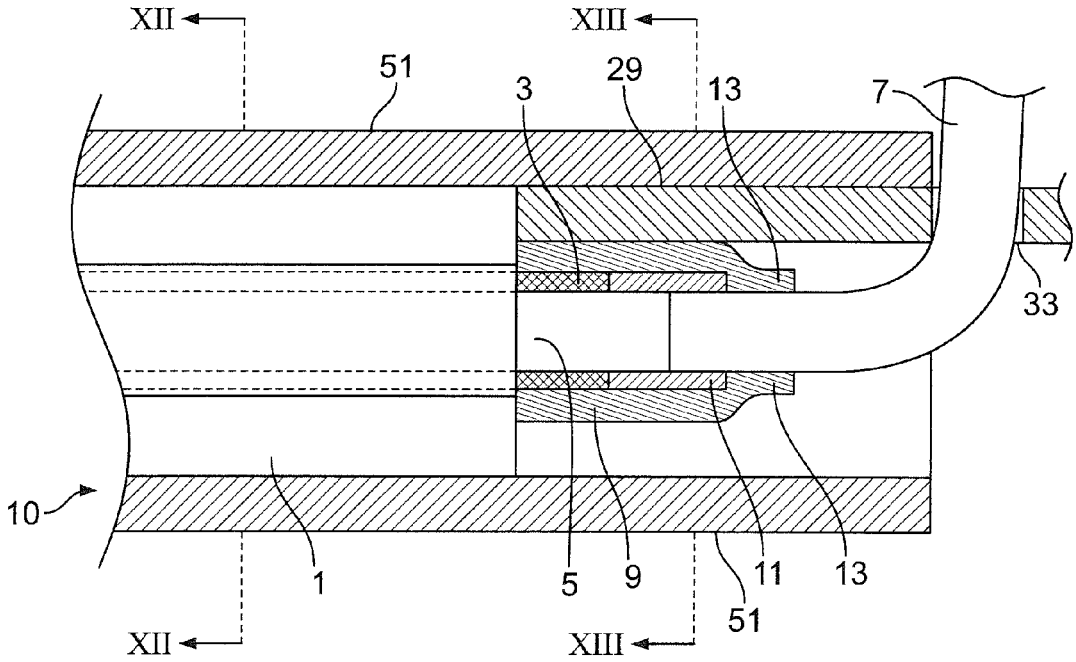
FIG. 11 shows a second embodiment of the invention, wherein the lead wire and heat cable are connected using a metal crimp in an uncrimped state.

FIG. 11 shows the assembly of the heater cable 10, the lead wire 7, and the splice connection 9 with a surrounding metal crimp 51. The crimp 51 longitudinally extends around the portion of the heater wire 5 that has its silicone insulation removed as well as around the heater cable 10 with its silicone insulation 1 intact. In this mode, the metal crimp 51 is not crimped.

Figure 12:
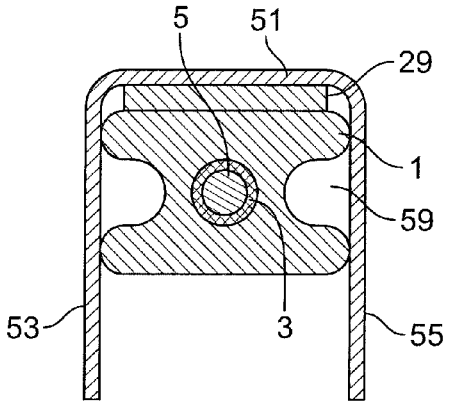
FIG. 12 shows a sectional view along the line XII-XII of FIG. 11.

FIG. 12 shows the sectional view of the metal crimp 51 as it surrounds the silicone insulation 1. The crimp is shown in its uncrimped state with a generally square configuration with two free ends 53 and 55, which would be bent to secure the tape section 29 of the zip tie segment 21 in place.

Figure 13:
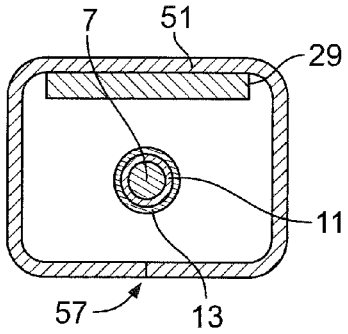
FIG. 13 shows a sectional view along the line XIII-XIII of FIG. 11.

FIG. 13 shows the metal crimp 51 as it surrounds the lead wire 7, the metal crimp 11 and heat shrink tubing 13. The ends 53 and 55 are shown in a partially crimped state, wherein the ends 53 and 55 meet at 57. While an abutting relationship is shown at 57 for the ends 53 and 55, the crimp could be sized so that the ends overlap as well. The cross section of the components to be crimped, as shown in FIG. 13, occupies less area since the silicone insulation 1 has been removed to allow the splice connection 9 to be made. Thus, more deformation of the metal crimp 51 occurs during the crimping operation so that the metal crimp 51 is forced against the outer surface of the heat shrink tubing 13 used in the splice connection 9 and any exposed lead wire 7 extending from the splice connection 9.

Once the metal crimp 51 is in place around both the silicone insulation 1 and the splice connection area, see FIGS. 12 and 13, it is mechanically crimped so that the zip tie tape section 29 is secured to the heater cable 10, the heater wire 5, splice connection 9, and lead wire 7. The metal crimping can also force the crimp into the recesses 59 formed by the I-beam shape and silicone insulation 1. If desired, the crimp would be preformed so that it follows the shape of the silicone insulation.

Figure 14:
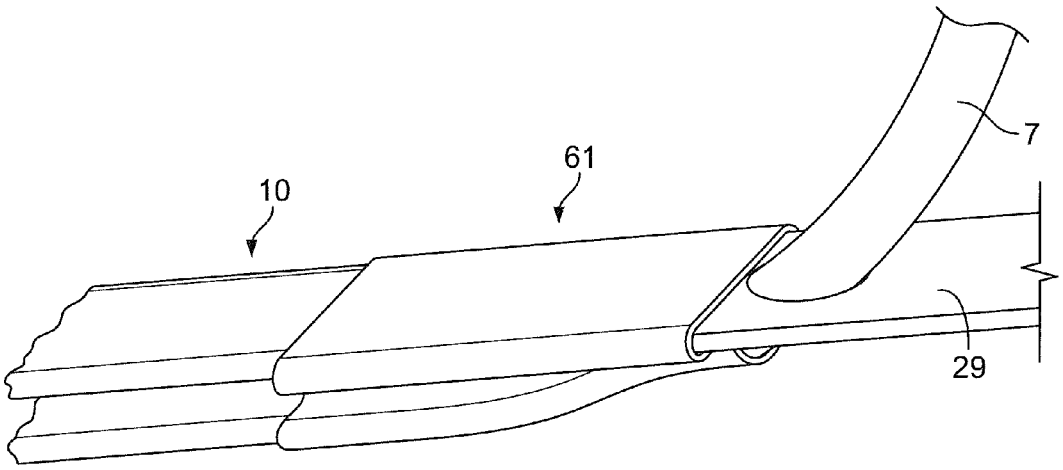
FIG. 14 shows a perspective view of the metal crimping embodiment with the metal crimp in its crimped state.

FIG. 14 shows a metal crimped portion 61, which is analogous to the overmolded portion 45 in terms of providing a better connection arrangement to the cable and means for tightening and clamping the heater cable 10 to the structure to be heated. Although not shown, the crimping around the i-shaped silicon insulation itself could entail a ripple crimp that would extend along the indent in the side of silicone insulation so that metal is not only crimped against the inner side wall (the bottom of the u-shape in the side wall of the insulation) but also against the surfaces of the silicone insulation that protrude from the bottom of the u-shape.

Although not shown in FIGS. 12 and 13, a mechanical fastening could be employed to further attach the crimp 51 to the tape section 29, which would be beyond just the attachment obtained by crimping alone. For example, a screw or other fastener could be employed to attach the tape section to the crimp together. An adhesive could also be employed if so desired.

Further and with reference to FIGS. 12-14, particularly FIG. 14, using the metal crimp 51 may be done with a tape section that does not contain the opening that is shown, for example, in FIG. 7. That is, the crimping action alone or in combination with another fastening, e.g., the fastener and/or adhesive, could be mechanically strong enough that the advantage obtained when the lead wire passes through the opening in the tape section in the overmolded embodiment is not necessary. Thus, the lead wire as shown in FIG. 14 would not extend through the tape section but would run parallel to it and extend underneath it in the FIG. 14 view.

Turning back to FIG. 10, the completed band heater assembly is designated as 100 and can be used as a band heater in virtually any application that requires heating. Typically, band heaters are used for compressors but any structure capable of receiving the band heater assembly 100 can be used in combination with the band heater assembly 100 for heating. The method of heating is well known in that the lead wires 7 of the assembly 100 are connected to the appropriate controls and power to resistively heat the wire 5, which in turn heats the material intended for heating by mounting the band heater assembly 100 in its desired place.

While one type of zip tie is illustrated, any type of zip tie can be used that entails a tape section on one end and a slotted head on the other end so that the one end can be pulled through the slot to tighten the band heater on a given structure. This zip tie is merely cut into two so that one segment is used on one end of the heater cable 10 and the other segment is used on the other end of the heater cable 10. The width of the tape sections 29 and 31 of the segments 21 and 23 can vary as each application requires. The width of the tape section can be wider or narrower than the width of the heater cable 10. However, a tape section width that approximates the width of the heater cable 10 is preferred since its use will result in a cleaner look for the overmolded portion 45 and less expense to engage in trimming operations, which cost time and money. The tape section can be thinner than the heater cable but have to have a sufficient width that the throughholes for the lead wires are formed.

The band heater assembly has a number of advantages, which are discussed below.

Since the heater cable employs a silicone insulation, there is no outer metal sheath to conduct heat through before reaching the compressor.

The absence of the metal in connection with the heater, e.g., no metal supports, means that there is no requirement for grounding and this reduces the overall costs of the heater assembly.

Using the zip ties means that the band heater assembly is simple to install. With the ease of linking the ends of the overmolded or crimped portions together using the zip tie, the band heater can be installed before, during, or after necessary work is to be done on the structure receiving the heater. For example, when a compressor is being heated, the compressor plumbing can be done independently of the band heater assembly attachment so that the band heater can be installed before, after, or even during the plumbing.

With the use of the zip tie segments and the throughhole in the zip tie tape section, extra strength is gained. In addition, a short zip tie can be used and be cut into two pieces, which reduces costs and can still be secured in place with enough strength to allow tightening of the band heater assembly on its intended structure.

The ends of the heater band are located under the zip tie tape section and thus are located on the compressor shell side. This draws heat away from the zip tie tape section to keep it cooler during operation.

Because zip ties are used, different types of zip ties can be employed, including those that are reusable and those that cannot be reused. The reusability feature means that if there is a mistake in the installation of the band heater assembly, the band heater assembly can be removed to rectify the mistake and re-installed.

When the fiberglass braid is employed to surround the resistance wire the inner fiberglass braid will spread the heat out over the silicone surface and add life to the dielectric strength. As the silicone ages, this braid will additionally allow less temperature on the surface and therefore fewer losses and better heat transfer to the ultimate attached item.

Another advantage is in the symmetric shape of the heater cable. With a flat surface on either side of the heater cable, either flat surface can be employed when producing the overmolded or crimped portions. In contrast, the "ohm" shaped heater cable of the Springer et al. patent can only be used in one orientation when heating a structure.

As such, an invention has been disclosed in terms of preferred embodiments thereof which fulfills each and every one of the objects of the present invention as set forth above and provides a new and improved silicone band heater, method of making, and method of use.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A silicone band heater cable assembly comprising:

a heater cable assembly comprising a resistance wire encased in a silicone insulator, the heater cable assembly having a first cable end and a second cable end;

a pair of lead wires, a splice connection between one end of each lead wire and a bare end of the resistance wire extending from each of the first and second cable ends of the heater cable assembly;

a zip tie, divided into a first zip tie segment comprising a head end with a slot and first tape section and a second zip tie segment comprising a second tape section, each of the first and second tape sections having an opening sized to allow the lead wire to pass therethrough, the first tape section attached to at least one splice connection to create a first attached portion and the second tape section attached to at least the other splice connection to create a second attached portion;

wherein the second tape section of the second zip tie segment can pass through the slot in the head end of the first zip tie segment to form a connected heater cable for clamping to a structure for heating.

2. The assembly of claim 1, wherein the attached portions are attached using molding compound to form overmolded portions.

3. The assembly of claim 2, wherein the first overmolded portion and the second overmolded portion are each surrounded by heat shrink tubing.

4. The assembly of claim 1, wherein an end of each of the first and second tape sections abuts an end face of the heater cable.

5. The assembly of claim 2, wherein an end of each of the first and second tape sections abuts an end face of the heater cable.

6. The assembly of claim 2, wherein the first tape section is overmolded on the splice connection so that the splice connection would be arranged between the first tape section and the structure and/or the second tape section is overmolded on the splice connection so that the splice connection would be arranged between the second tape section and the structure.

7. A silicone band heater cable assembly comprising:

a heater cable assembly comprising a resistance wire encased in a silicone insulator, the heater cable assembly having a first cable end and a second cable end;

a pair of lead wires, a splice connection between one end of each lead wire and a bare end of the resistance wire extending from each of the first and second cable ends of the heater cable assembly;

a zip tie, divided into a first zip tie segment comprising a head end with a slot and first tape section and a second zip tie segment comprising a second tape section, each of the first and second tape sections having an opening sized to allow the lead wire to pass therethrough, the first tape section attached to at least one splice connection to create a first attached portion and the second tape section attached to at least the other splice connection to create a second attached portion;

wherein the second tape section of the second zip tie segment can pass through the slot in the head end of the first zip tie segment to form a connected heater cable for clamping to a structure for heating wherein the first and second tape sections are each formed with a step to facilitate the forming of the attached portions, each step including the opening in each of the first and second tape sections.

8. The assembly of claim 2, wherein the first and second tape sections are each formed with a step to facilitate the attaching and the opening in each of the first and second tape sections.

9. The assembly of claim 1, wherein an end of each of the first and second tape sections overlaps the first and second cable ends of the heater cable, respectively.

10. The assembly of claim 2, wherein an end of each of the first and second tape sections overlaps the first and second cable ends of the heater cable, respectively.

11. The assembly of claim 1, wherein a metal crimp is used for forming of the first and second attachment portions, the metal crimp crimping the tape section, the heater cable, and splice connection for each of the first and second cable ends.

12. The assembly of claim 2, wherein each overmolded portion includes a molding compound that surrounds a portion of the heater cable, a portion of the tape section, and the splice connection.

13. The assembly of claim 1, wherein the head end of the first zip tie segment is configured to releasably connect to the tape section of the second zip tie segment.

14. The assembly of claim 1, wherein a fiberglass braid is positioned between the resistance wire and the silicone insulation.

15. In a method of heating a material using a silicone band heater cable assembly, the improvement comprising using the silicone band heater cable assembly of claim 1 for said heating.

16. A method of making a silicone band heater comprising:

providing a silicone heater cable having a resistance wire and a silicone insulator, the silicone heater cable having a first cable end and a second cable end;

providing a pair of lead wires, crimping together an end of each lead wire and an end of each resistance wire to form a splice connection;

positioning a tape section of a zip tie segment with an opening in it adjacent to at least the splice connection at each cable end and threading the lead wire through the opening, attaching each tape section, each splice connection, each lead wire, and each of the first and second cable ends together to form an attached portion so that the zip tie segments can be used to connect the first and second ends of the heater cable together.

17. The method of claim 16, wherein the attaching step further comprises using a molding compound to form an overmolded portion as the attached portion.

18. The method of claim 16, wherein the attaching step further comprises using a metal crimp to attach each tape section and each splice connection to each of the first and second heater cable ends.

19. A method of making a silicone band heater comprising:

providing a silicone heater cable having a resistance wire and a silicone insulator, the silicone heater cable having a first cable end and a second cable end;

providing a pair of lead wires, crimping together an end of each lead wire and an end of each resistance wire to form a splice connection;

positioning a tape section of a zip tie segment with an opening in it adjacent to at least the splice connection at each cable end and threading the lead wire through the opening, attaching each tape section, each splice connection, each lead wire, and each of the first and second cable ends together to form an attached portion so that the zip tie segments can be used to connect the first and second ends of the heater cable together wherein each of the tape sections has a step where the opening is located.

* * * * *